US005472523A

United States Patent [19]

Harelstad

[11] Patent Number: 5,472,523

[45] Date of Patent: Dec. 5, 1995

[54] METHOD AND COMPOSITION FOR TREATMENT OF PHOSPHATE COATED METAL SURFACES

[75] Inventor: Wayne A. Harelstad, Woodbury, Minn.

[73] Assignee: Fremont Industries, Inc., Shakopee, Minn.

[21] Appl. No.: 403,438

[22] Filed: Mar. 14, 1995

Related U.S. Application Data

[62] Division of Ser. No. 253,104, Jun. 2, 1994.

[51] Int. Cl.[6] ..... C23C 22/83

[52] U.S. Cl. ..... 148/255; 148/247

[58] Field of Search ..... 148/255, 257

[56] References Cited

U.S. PATENT DOCUMENTS

| | | |
|---|---|---|
| 3,063,877 | 11/1962 | Schiffman . |
| 3,279,958 | 10/1966 | Maurer et al. . |
| 3,720,547 | 3/1973 | Melotik . |
| 3,819,423 | 6/1974 | Charles et al. . |
| 3,850,732 | 11/1974 | Binns . |
| 3,852,123 | 12/1974 | Goltz . |
| 3,877,998 | 4/1975 | Guhde . |
| 3,961,992 | 6/1976 | Jahnke et al. . |
| 3,966,502 | 6/1976 | Binns . |
| 4,039,353 | 8/1977 | Kulick et al. . |
| 4,174,980 | 11/1979 | Howell, Jr. et al. . |
| 4,220,485 | 9/1980 | Howell et al. . |
| 4,376,000 | 3/1983 | Lindert . |
| 4,421,765 | 12/1983 | Sallmann et al. . |
| 4,517,028 | 5/1985 | Lindert . |
| 4,650,526 | 3/1987 | Claffey et al. . |
| 4,656,097 | 4/1987 | Claffey et al. . |
| 5,102,457 | 4/1992 | Braig et al. . |
| 5,226,976 | 7/1993 | Carlson et al. . |
| 5,260,357 | 11/1993 | Sachdeva . |
| 5,350,830 | 9/1994 | Kuo et al. . |

*Primary Examiner*—Sam Silverberg
*Attorney, Agent, or Firm*—Haugen and Nikolai

[57] ABSTRACT

A final seal rinse or pre-treatment for improving the adhesion and corrosion protection afforded by application of organic coatings to metallic substrates, with the seal rinse comprising an aqueous solution of comprising an effective concentration of (2-benzothiazolylthio) succinic acid and morpholine. The formulation, in a working solution, provides a treatment process which increases the corrosion protection of painted metallic parts, particularly ferrous parts, to an extent previously offered by chromated seal rinses. The seal rinse of the present invention is compatible with fresh water from conventional sources, and is also adapted for use with deionized water including a final deionized water post-rinse. In addition, the formulation of the present invention is particularly adapted for use with materials previously treated with phosphate. A working formulation of the present invention includes (2-benzothiazolylthio) succinic acid and morpholine in an effective concentration wherein the weight ratio of the succinic acid derivative to morpholine ranges from between about 1:0.5 and 1:1, and wherein the pH is between 6 and 10.

1 Claim, 1 Drawing Sheet

METHOD AND COMPOSITION FOR TREATMENT OF PHOSPHATE COATED METAL SURFACES

This is a Divisional of copending application Ser. No. 08/253,104, filed on Jun. 2, 1994.

BACKGROUND OF THE INVENTION

The present invention relates generally to an improved composition and/or formulation and method for the treatment of metallic surfaces, and more specifically to an improved aqueous formulation adapted to be employed in a working solution for use as a seal rinse for increasing the corrosion protection of painted metallic substrates. The seal rinse formulations of the present invention comprise morpholine and (2-benzothiazolylthio) succinic acid in an effective concentration to form a morpholine salt, the formulations being highly suited for use with surfaces of metallic substrates which have been previously phosphatized with typical phosphate baths.

Techniques for cleaning and preparing metals, particularly ferrous metals prior to coating with an organic top coat have long existed. Effective cleaning is necessary in order to promote adhesion of the organic coating to the metallic substrate and to increase the corrosion protection available for the painted product. Preparation of metallic surfaces involves initially cleaning and/or removing all organic soils, inorganic soils, and particulate material. Organic soils may be present in the form of petroleum oils and greases, polymers, or soaps. Inorganic soils may be present in the form of rust, smut, scale and/or particulate material. Following the cleaning operation, the metallic substrate is exposed to a phosphatizing bath where, in the case of ferrous materials, an iron phosphate surface coating is developed. The primary purpose of the phosphate coating is to convert the normally conductive surface to one which is essentially non-conductive. The non-conductive character minimizes or eliminates what is typically characterized as "flash rusting" which frequently occurs between the time an article has been cleaned and prior to the time that the surface of the article may be painted or otherwise covered with a protective and durable film. The non-conductive character further reduces the rate of corrosion of the surface of the ferrous substrate following painting. For non-ferrous materials, the phosphatizing bath micro-etches the metal substrate and tends to neutralize any alkalinity present on the metal from exposure to previous treatments or otherwise.

The formulations of the present invention are particularly adapted for use as a seal rinse on metallic surfaces following phosphate treatment. Two techniques are typically used for phosphatizing ferrous substrates, these being zinc phosphatizing and iron phosphatizing. Zinc phosphatizing requires careful process control, since the operating parameters are normally quite narrow. In addition, and perhaps more seriously, zinc phosphatizing contains nickel and may also contain manganese, copper, or others in addition to zinc. Control of adverse impacts on the environment provide extensive limitations upon the use of such processes. Iron phosphatizing is generally recognized as far more acceptable, and may in certain instances, be used in combination with accelerating agents such as alkali metal chlorates or bromates, or organic type oxidizing agents. The formulations of the present invention have been found to function exceptionally well when used on surfaces following iron phosphatizing treatment.

In addition to the use of chlorates and bromates, iodates may be employed. Ammonium salts may also be employed in the definition of alkali metals. The presence of the accelerator components promotes a heavier phosphate coating, normally in the 40–70 mg/ft.$^2$ range. Molybdated products also produce some benefits due to cross-plating onto ferrous substrates. However, such products do not impede the rate of corrosion of a ferrous substrate as effectively as phosphate coatings utilizing alkali metal halidates such as chlorates or bromates as accelerators.

Seal rinse formulations for treatment of metallic surfaces have typically involved the following:

1. Chromate's/heavy metals;
2. Phenol formaldehyde resins;
3. Polymeric-chemicals;
4. Phosphoric acid based products;
5. Deionized water/reverse osmosis water;
6. Tannic acid/tannates; or
7. Styrenes.

Each of these have limitations and/or are currently prohibited for use, with some of the disadvantages stemming from the following. While chromates have provided the best overall protection in the past, the effluent discharge levels imposed by the EPA (Environmental Protection Agency) because of their carcinogenic effects and for other reasons, the use has become extremely limited. Heavy metals such as zinc, lead and copper generally provide a lower degree of corrosion protection than chromium, and their disposal also presents limitations upon use. Other metals or salts of metals including molybdates, tungstates, vanadates, zirconium, and the like have provided certain benefits in inhibiting flash rust on ferrous substrates, however their ability to provide corrosion protection is generally limited. When modified to provide corrosion protection of certain painted metallic substrates, their uses tend to be extremely limited, due to the coating-specific nature of their performance.

Certain non-chromate and non-metallic seal rinse formulations which have been developed may suffer from disadvantages due to the current regulations imposed by Governmental agencies. Recently, one final rinse which has been recognized is deionized water, or water prepared from reverse osmosis operations, with both of these having a generally neutral pH and the absence of dissolved solids. These tend to be costly and hence not generally economically feasible, and hence not widely practiced.

Phosphoric acid based seal rinses, as previously discussed, provide resistance to flash rusting but are generally considered weak for corrosion protection of painted metallic substrates. Other rinses including certain organic acid based rinses have limitations demonstrated in either resistance to flash rusting or, in providing only limited long-term corrosion protection.

SUMMARY OF THE INVENTION

In accordance with the present invention, however, the final seal rinse is based upon the morpholine salt of (2-benzothiazolylthio) succinic acid, and is non-metallic, containing neither chromates nor heavy metals. Moreover, the formulation does not contain components releasing nascent formaldehyde, is non-phenolic, and offers superior corrosion protection on metallic surfaces. The working solutions are low-foaming and hence can be used both in immersion and spray applications without requiring use of external defoamers. Silicone or petroleum based defoamers have been found to reduce adhesion and corrosion protection on ferrous substrates.

Turning now to the individual steps involved in both pre-treatment and treatment of metal surfaces in accordance with the present invention, the following discussion is deemed appropriate.

Surface Cleaning

The first step normally involved in metal pre-treatment is removal of organic soils such as chlorinated/sulfurized oils, stearates, buffing compounds, mill oils, hydraulic oils, waxes, as well as certain soluble oils. Inorganic soils must also be removed. Low temperature alkaline cleaners are typically employed, or a phosphatizing agent containing a surfactant for oil emulsification may also be employed. For certain inorganic soil loading, mechanical abrasion may be utilized.

Phosphatizing

Once free of organic soils, the part must be phosphatized to prevent flash rusting. The initial step in the overall phosphatizing mechanism is the pickling of the ferrous substrate, and pickling (dissolving of metal) cannot be accomplished unless the metal substrate is free of organic soils. The phosphatizing process is undertaken as described above.

Seal Rinse

It is known that the derivatives of benzothiazole may be used to improve the corrosion protection properties of organic coatings (paint) when formulated into the composition. The use of benzothiazole derivatives, more specifically the morpholine salt of (2-benzothiazolylthio) succinic acid, for seal rinse application is unique and specific to the seal rinse formulation of the present invention.

The seal rinse of the present invention is applied following phosphatizing, this application being the last functional chemical bath in a surface treatment process, with a water post-rinse operation sometimes being employed. Immersion systems or recirculating power washer systems may be employed, with contact times ranging from between about 5 seconds to about 5 minutes, depending upon the mechanical features of the pre-treatment equipment (conveyor speed) as well as the complexities of geometry of the products being treated. Immersion and/or recirculating spray operations permit reuse of the morpholine salt of the thio-organic acid derivative of benzothiazole which is a substantial benefit for quality, production, economic, and environmental concerns.

Morpholine is a desirable component since trace amounts of morpholine present following treatment will volatilize so as to create an additional semi-solid coating on the metallic substrate. This coating is neutral at room temperatures, and further protects the metal from flash rusting. At temperatures achieved in powder coating operations, the morpholine salts fuse and become reactive in powder coating paints. The seal coating of the present invention is organic in nature, and the morpholine salt being present is useful with water-based and solvent-based paints as well. Morpholine is desirable due to its high volatility over other amines and inorganic sources, i.e., sodium hydroxide, potassium, hydroxide, ammonium hydroxide which do not form protective films over the metal substrates. To the contrary, inorganic salts form a powdery residue upon dehydration (not a film) which contributes to a reduction in the corrosion protection for metallic substrates.

Non-phosphatized zones or voids frequently occur in typical iron phosphate coatings. If not further treated, flash rusting may occur in these zones. In connection with the present invention, however, the morpholine salt of an organic acid derivative of benzothiazole fills such voids in the phosphate coating as well as discontinuities in the topography of the metal substrate so as to provide an overall and continuous sealing effect, with evidence of such effects having been found in SEM photographs. In other words, seal rinses based upon the formulations of the present invention enhance the corrosion protection available from conventional paint films when applied to metallic surfaces.

Therefore, it is a primary object of the present invention to provide an improved seal rinse for metallic substrates which provides superior flash rust protection prior to painting, while increasing the corrosion protection of the subsequently painted metallic substrate, with the working solution of the formulation comprising an aqueous solution of morpholine and (2-benzothiazolylthio) succinic acid.

It is a further object of the present invention to provide an improved formulation for treatment of metallic surfaces, with the formulation being ultimately compatible with a wide variety of organic paints and coatings, including water-based and solvent-based paints, along with powder coatings.

It is yet a further object of the present invention to provide a formulation for the treatment of metallic surfaces comprising morpholine and (2-benzothiazolylthio) succinic acid, and wherein the working solutions have a pH which ranges between about 6 and 10, and preferably at a level of between 7.0 and 7.5.

It is yet a further object of the present invention to provide a seal rinse containing the morpholine salt of a thio-organic acid derivative of benzothiazole, which is susceptible of use in immersion, as well as recirculating and non-recirculating spray applications.

Other and further objects of the present invention will become apparent to those skilled in the art upon a study of the following specification, appended claims, and accompanying drawings.

DESCRIPTION OF THE PREFERRED EMBODIMENT

Figure 2:
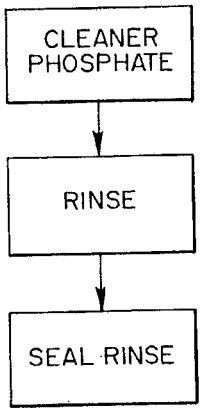
FIG. 2 is a flow chart showing a three-step operation applicable to the processes involved in the present invention.

While the present invention has a wide variety of specific applications including immersion or recirculating sprays, one typical application is consistent with that illustrated in the drawings. Also, while FIG. 3 sets forth the details of a five-step operation, three-step operations in accordance with the flow chart of FIG. 2 are commonly utilized, and those skilled in the art may readily convert the three-step operation of the flow chart of FIG. 2 into a facility similar to that illustrated in FIG. 3.

Figure 1:
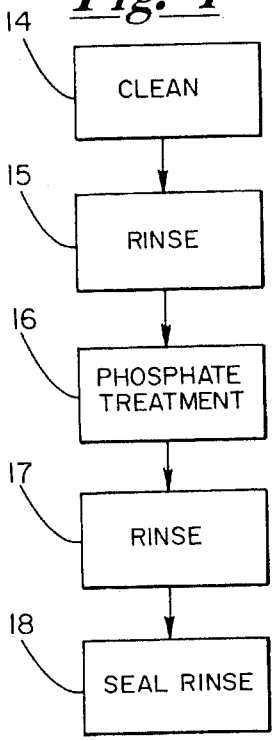
FIG. 1 is a flow chart showing a five-step operation typically involved in undertaking the processes involved in the present invention.
Figure 3:
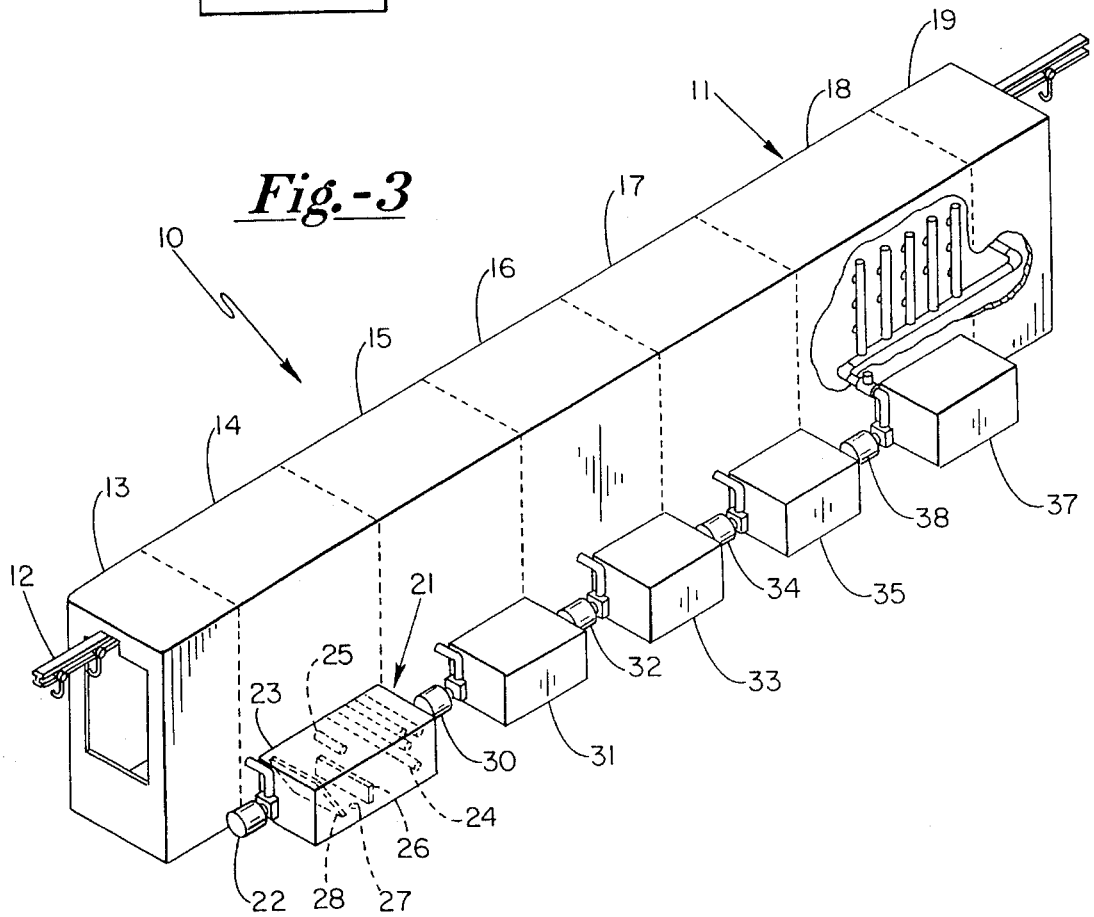
FIG. 3 is a perspective view, partially broken away, illustrating a five-step arrangement of facilities for undertaking the various operations involved in the present invention.

The individual operations set forth in the flow chart of FIG. 1 are undertaken conveniently in an apparatus of the type illustrated in FIG. 3. The enclosure or operating chambers generally designated 10 includes a series of shrouded zones created in a sheet metal shell 11. Shell 11 houses overhead conveyor rail 12 which extends from an inlet port at the upstream or infeed end to an outlet port at the downstream or outfeed end. Adjacent the infeed is a first chamber 13 which provides an entry zone leading to the first operational stage which is a cleaning stage disposed within the chamber as-at 14. The second operational stage is a rinse stage enclosed within chamber 15. Chamber 16 encloses a phosphate treatment stage, with a rinse stage being provided within the enclosure as at 17. The final operational stage is the seal rinse stage which is undertaken within the chamber as at 18, with the exit shroud portion being shown at 19.

With attention being directed to the cleaning stage shown at 14, this stage will typically employ a spray mechanism as illustrated. Pump 22 extracts cleaning solution or fluid from reservoir within cleaning solution treatment vessel 23, vessel 23 controlling the quality and composition of the solution. This reservoir typically employs steam coils as shown at 24 for temperature control, although burner tubes or heat exchangers may also be used. An over-flow or weir as at 25 is provided for permitting cleaning solution to move forward to pump 22. A sludge weir or baffle is provided as at 26, with a drain for the sludge station being provided as at 27. Filter screen 28 aids in clarifying the cleaning solution as it moves through the system and returns to pump 22 for ultimate disposition through its internally disposed manifold and spray riser assembly or dip treatment vessel.

Turning to rinse stage 15, this stage utilizes pump 30 drawing its supply of rinse water from vessel or reservoir 31. Either a dip or spray mechanism may be employed in this stage, depending upon the geometry of the product being treated, with a spray mechanism being more typically employed.

Phosphate treatment stage 16 utilizes a phosphate rinse which is normally applied through either a spray and/or dip system. The formulations useful for this treatment are discussed hereinafter. Phosphate treatment stage 16 employs pump 32 which draws its supply of fluid from vessel 33. This phosphate treatment stage 16 is followed by a rinse stage 17 which employs either a series of spray risers as in the cleaning stage 14, or alternatively a dip operation. Rinse stage 17 employs pump 34 which draws its supply of rinse fluid from vessel 35.

The seal rinse of the present invention is applied in a working solution at stage 18. A working solution of the seal rinse of the present invention is retained within vessel 37, and employs pump 38 for delivering the working solution to the spray mechanism or dip reservoir within the shroud. Vessel 37 may or may not employ a heating mechanism, i.e. burner tube, steam coils or heat exchanger. A heated solution accelerates the reaction of the seal rinse to the metal substrate and reduces the dry off time of the aqueous solution on the metallic part. Following application of the seal rinse, an additional rinse operation or step may be employed, if desired, with tap water or deionized water being employed, as desired.

DESCRIPTION OF THE PREFERRED EMBODIMENTS AND FORMULATIONS

In accordance with the present invention, and the formulations found to produce results illustrative of the concept, the following examples are provided:

GENERAL EXAMPLE, SEAL RINSE

A seal rinse composed of:

| Ingredient | Percent by Weight |
|---|---|
| Water | 30–98.5 |
| Morpholine | 0.5–35 |
| (2-benzothiazolylthio) succinic acid | 1–35 |

The seal rinse is used at from 0.1% to 3% by volume from ambient to about 140° F. for a period of at least about 5 seconds and up to about 4 minutes, depending on the method of application. The pH is between about 6 and 10, with a preferred pH range being between 7.0 and 7.5. Generally, the pH is either equal to or slightly greater than the pH of the raw water being employed.

GENERAL EXAMPLE, PHOSPHATIZING PRE-TREAT

The iron phosphates of choice used in pre-treatment were composed of the following formulations:

| Ingredient | Percent by Weight |
|---|---|
| Sodium bromate type: | |
| Water | 70 |
| Sodium bromate | 10 |
| 75% phosphoric acid | 20 |
| Sodium chlorate type: | |
| Water | 70 |
| Sodium chlorate | 10 |
| 75% phosphoric acid | 20 |

Also found useful are the molybdate type:

| Ingredient | Percent by Weight |
|---|---|
| Water | 79 |
| Sodium molybdate | 1 |
| 75% phosphoric acid | 20 |

The phosphates were charged at 4% by volume and heated to 140° F. The pH of the bath is then adjusted with sodium hydroxide to 4.5–5.0 and panels are sprayed for 60 to 90 seconds. Following phosphatizing, the panels are then rinsed and at that time are ready for treatment with the seal rinse. In another application, detergents were added to these pre-treatment solutions for three-stage operations where phosphatizing and cleaning operations may be combined.

EXAMPLE I

The seal rinse of this example consists of the following formulation:

| Ingredient | Percent by Weight |
|---|---|
| Morpholine (2-benzothiazolylthio) | 14% |
| Succinic acid | 20% |
| Water (balance) | 66% |

The seal rinse is used at 1% by volume at a temperature of 100° F. for an exposure period of 30 seconds. The working solution has a pH of 7.5.

Comparative studies were undertaken wherein steel panels were pre-treated using the sodium chlorate accelerated phosphate formulation of General Example, Phosphatize Pre-Treat, and subjected to three different seal rinses, including the seal rinse above. Thereafter, each steel panel was painted with a polyester powder coating which was cured at 400° F. for 15 minutes. The panels were then vertically scribed as cited per A.S.T.M. B-117. The panels were subjected to A.S.T.M. salt spray for differing periods of time. Since A.S.T.M. salt spray is a comparative corrosion test, panels were treated with the same phosphate source as provided above, however some of the panels were final rinsed with the seal rinse of this Example, some with distilled water, and some others were final rinsed in tap water. The painted panels were then subjected to salt spray. After a certain time in the salt spray chamber, the panels were removed, rinsed in warm running water and blotted dry with a paper towel. The panels were then subjected to a tape pull and a knife scrape along the scribe (A.S.T.M. 1654 Procedure A, Method 2) and the mean creepage (paint lift) from the scribe was measured. The results of salt spray testing were as follows:

| Seal Rinse | Mean Creepage (168 hrs Salt Spray) | Mean Creepage (336 hrs Salt Spray) |
|---|---|---|
| Seal rinse of Example I in tap water | none | 1/32 inch |
| Only deionized water | 1/16 inch | 1/8 inch |
| Only tap water | 1/16–1/8 inch | 3/16–1/4 inch |

EXAMPLE II

The molybdate accelerated phosphate was employed as the iron phosphate source. The three rinses evaluated with the phosphate were:

1. Deionized water;
2. The seal rinse of Example I in raw water;
3. Tap water.

The same paint and same testing/evaluation methods were used as cited in Example I. The results of salt spray testing were as follows:

| Seal Rinse | 72 hr. Creepage | 168 hr. Creepage | 336 hr. Creepage |
|---|---|---|---|
| Seal rinse of Example I | 1/16 inch | 1/8 inch | 1/4 inch |
| Only deionized water | 1/16 inch | 1/8 inch | 1/4 inch |
| Only tap water | 3/16–1/4 inch | 3/8 inch | 5/8 inch |

This example showed that the use of the seal rinse of the present invention with a different phosphate, while keeping the paint constant, gave equivalent results to deionized water when the seal rinse was used in tap water which is desirable since deionized water is not a realistic component for use in many manufacturing facilities.

EXAMPLE III

To determine if the seal rinse of the present invention reacts with the phosphatized metal, a test comparing the corrosion protection of the sodium chlorate accelerated phosphate with:

1. Deionized water.
2. The seal rinse of Example I in tap water.
3. The seal rinse of Example I in tap water with a deionized water post-rinse.

If indeed the seal rinse components were reacting with the phosphatized meal, the panel with the seal rinse with a post-deionized rinse should out-perform the deionized water final seal rinse panel as cited in Example I above. The paint for this test was a polyester epoxy hybrid which was cured at 360° F. for 20 minutes. Salt spray testing and evaluation were conducted as cited in the above examples. The result of salt spray testing were as follows:

| Final rinse | 200 hr. Creepage | 336 hr. Creepage | 500 hr. Creepage |
|---|---|---|---|
| Deionized water | 1/16 inch | 1/8 inch | 3/16 inch |
| The seal rinse of Example I in tap water | 1/32–1/16 | 1/16–1/8 inch | 1/8 inch |
| The seal rinse of Example I in tap water with a deionized water post-rinse | 1/32 inch | 1/16 inch | 1/16 inch |

The seal rinse of the present invention increases the corrosion protection over that obtained with a deionized water final seal by using the thio-organic acid derivative of benzothiazole in tap water. Since the best non-chrome, non-heavy metal seal rinses are found to be extremely coating specific to their corrosion protection, deionized water is generally accepted as the best rinse for corrosion protection for the widest variety of coatings. Further protection can be provided by using the thio-organic derivative seal of benzothiazole when the seal is used with a final deionized water seal as cited in Example III above. Tests have also shown that even a tap water rinse after the seal rinse of the present invention extends corrosion protection beyond that obtained by deionized water, tap water, or the seal rinse of the seal rinse of the present invention in tap water. Further, even greater corrosion protection can be provided by using the seal rinse of the seal rinse with deionized water as bath make-up water with a deionized water post-rinse.

EXAMPLE IV

The sodium chlorate and the sodium bromate accelerated iron phosphates of Example I were employed as an iron phosphate source. The two final rinses for this testing were deionized water and the seal rinse of Example I in tap water. The pre-treated panels were powder coated with an epoxy powder coating and cured at 385° F. for 30 minutes. The panels were then scribed and subjected to salt spray testing for the determined number of hours. After salt spray testing, the panels were evaluated as cited in the earlier examples. The results of salt spray testing were as follows:

| Phosphate | Seal Rinse | 168 hrs. | 336 hrs. | 500 hrs. |
|---|---|---|---|---|
| Sodium bromate accelerated | deionized water | 1/8 inch | 1/4 inch | 3/8 inch |
| Sodium chlorate accelerated | deionized water | 1/8 inch | 1/4 inch | 3/8 inch |
| Sodium bromate accelerated | seal rinse of Example I | 1/32–1/16 | 1/16 inch | 1/16–1/8 |
| Sodium chlorate accelerated | seal rinse of | 1/16–1/8 | 3/16–1/4 | 1/4 inch |

-continued

| Phosphate | Seal Rinse | 168 hrs. | 336 hrs. | 500 hrs. |
|---|---|---|---|---|
| | Example I | | | |

EXAMPLE V

The phosphate for this example was the sodium bromate accelerated phosphate of Example I. Two final rinses for this experiment were deionized water and the seal rinse of the present invention. Panels were pre-treated and painted with a high solids urethan wet paint. The paint was cured at 320° F. for 15 minutes. The panels were then scribed and exposed to salt spray testing as cited in the earlier examples. The panels were removed from the salt spray cabinet and evaluated as cited in the earlier examples. The results of salt spray testing were as follows:

| Final Rinse | Mean Creepage at 168 hrs. | Mean Creepage at 336 hrs. | Mean Creepage at 500 hrs. |
|---|---|---|---|
| Deionized water | 3/16 inch | ½ inch | ½ inch |
| The seal rinse of Example I | none | ⅛ inch | ⅛ inch |

EXAMPLE VI

Two different phosphates in two different pre-treatment processes were evaluated. Two different final rinses were also evaluated. This work compared the use of sodium bromate accelerated phosphate in a five-stage recirculating spray system and the use of a sodium chlorate accelerated phosphate in a five-stage recirculating spray system which employed an alkaline cleaner prior to phosphatizing. The seal rinse of the present invention was evaluated for both processes as was deionized water as the final rinse, and a chromated seal rinse. The paint for this experiment was a two component epoxy wet coating which was cured at 250° F. for 5 minutes. The panels were given a seven-day post-cure prior to scribing and salt spray exposure. The panels were exposed to A.S.T.M. salt spray for 240 hours, after which time they were removed and evaluated as cited in the earlier examples. The results of salt spray testing are summarized as follows:

| Phosphate | Final Rinse | Mean Creepage at 240 hours |
|---|---|---|
| Sodium chlorate | deionized water | 1/16–⅛ inch |
| Sodium chlorate | Seal rinse of Example I | 1/16–⅛ inch |
| Sodium chlorate | 80 PPM chrome | 1/16 inch |
| Sodium bromate | deionized water | ¼ inch |
| Sodium bromate | Seal rinse of Example I | 1/32–1/16 inch |
| Sodium bromate | 80 PPM chrome | 1/16 inch |

EXAMPLE VII

The seal rinse of Example I was evaluated with tap water as make-up water. Tap water composed of 450 micromhos of conductivity with a pH of 7.5 and consisting of 16 grains of water hardness. The alkalinity of the water was 300 PPM $CaCO_3$. This was evaluated as well as the seal rinse with deionized water as make-up. Deionized water and tap water were evaluated also as post-rinses to the seal rinses containing them as bath make-up. Again, deionized water was evaluated for comparison. The coating for this experiment was a TGIC polyester powder coating which was cured at 385° F. for 20 minutes. The panels were scribed, exposed to salt spray, and evaluated as cited in the earlier examples. The phosphate for this example was sodium bromate. The results of salt spray testing were as follows:

| Final Rinse | Mean Creepage at 168 hrs. | Mean Creepage at 336 hrs. |
|---|---|---|
| Deionized water | ⅛ inch | ¼ inch |
| Seal rinse of Example I in tap water | 1/16–⅛ inch | ⅛–3/16 inch |
| Seal rinse of Example I in deionized water | 1/16 inch | ⅛ inch |
| Seal rinse of Example I in tap water with tap post-rinse | 1/32 inch | 1/16 inch |
| Seal rinse of Example I in deionized water with deionized post-rinse | 1/32 inch | 1/32–1/16 inch |

EXAMPLE VIII

Panels were pre-treated using a sodium chlorate iron phosphate and with two differing compositions of the sodium bromate iron phosphate (one with sodium bromate at 10%; the other at a level of 1%). The panels were then painted with an epoxy anodic electrodeposition process. Electrodeposition consistently delivers a low paint mileage to the metallic substrate (0.8–1.2 mils). Further history has shown that anodic electrodeposition coatings provide far less corrosion protection on ferrous substrates as compared to cathodic electrodeposition. The final rinses employed for this test were as follows:

1. Deionized water;
2. Phosphoric acid based (in tap water); and
3. Seal rinse of Example I in tap water.

It is important to note that items #2 and #3 herein were followed by a deionized water post-rinse prior to electrocoating which is necessary to remove any unreacted solids from the metal substrate. The panels were scribed and subjected to A.S.T.M. B-117 salt spray for 72 hours. The panels were then evaluated as cited in the earlier examples. The results of salt spray testing were as follows:

| Phosphate | Final Rinse | Mean Creepage at 72 hrs. |
|---|---|---|
| Sodium chlorate | deionized water | 3/16 inch |
| Sodium chlorate | phosphoric acid based | ⅛ inch |
| Sodium chlorate | seal rinse of Example I | 1/16–⅛ inch |
| Sodium bromate 1% | deionized water | 1/16–⅛ inch |
| Sodium bromate 1% | phosphoric acid based | 3/16 inch |
| Sodium bromate 1% | seal rinse of Example I | 1/32–1/16 inch |
| Sodium bromate 10% | deionized water | ¼ inch |
| Sodium bromate 10% | phosphoric acid based | ¼ inch |
| Sodium bromate 10% | seal rinse of Example I | 1/16 inch |

Example I

The seal rinse described in General Example, Seal Rinse hereinabove, is effective with all types of water quality and which works with a wide variety of different iron phosphates and coatings to extend the corrosion protection of painted metallic substrates and to prevent flash rusting of the ferrous substrate prior to painting.

The seal rinse of the present invention demonstrates superior corrosion protection when used in iron phosphatizing pre-treatment processes. The morpholine salt of (2-benzothiazolylthio) succinic acid which is used as the seal rinse forms a semi-solid at room temperature, which is sparingly soluble upon immediate exposure to water and becomes liquid when heated (i.e. the curing oven of a painting process). Once liquid, the seal fuses with the paint and provides superior corrosion protection of the metallic substrate. The seal rinse contains no chromates or heavy metal and may be used on most metals including steel, galvanized, tin-plated steel, zinc, and aluminum without any adverse affects. The seal rinse is non-corrosive to steel equipment unlike many of the tannic acid and other organic acid-based seal rinse chemistries currently employed. This was verified by determining the weight loss of a 1010 steel corrosion coupon were after 30 days exposure to the seal rinse, a weight loss of only 0.0065% was determined.

The seal rinse of the present invention extends the corrosion protection of metallic substrates with a variety of paints, and in particular performs especially well with the powder coatings. Powder coatings in industrial use today exist in a wide variety of resin systems such as:

1. Polyester;
2. Epoxy;
3. Acrylics;
4. Polyester epoxy hybrids;
5. Urethane; or
6. TGIC (triglycidyl isocyanurate) polyester.

When morpholine salt of (2-benzothiazolylthio) succinic acid is used as the seal, a protective film is formed on the metallic substrate. When the charged powder coated part is passed through a curing oven to fuse the pulverized material, the material flows and cross-links to form the cured finish coating. Powder coating is one of the more popular methods of coating metallic substrates in place of wet coating because it can be reclaimed and reused, and has no V.O.C.'s and hence desirable for the environment. The use of powder coating continues to increase, and is, of course, widely employed.

The morpholine and (2-benzothiazolylthio) succinic acid works in a synergistic fashion in that morpholine by itself does not increase corrosion protection of ferrous substrates. Morpholine by itself completely volatilizes in the process leaving no seal film. Further, the (2-benzothiazolylthio) succinic acid is insoluble in water and becomes soluble when morpholine is added to create the salt. Morpholine must be present in such an amount that all of the acid is neutralized. Tests have shown that any amount of excess acid such as use of a working solution with a pH less than about 6 tends to be sufficiently corrosive to steel so as to provide lesser flash rust protection and a substantial reduction in the protection of painted metallic substrates. The formulations of the present invention have been found to provide protection for metallic surfaces which rival the protection available from chromate-based rinses. The non-chromate post-seal rinses of the present invention function well with phosphatized metals and are particularly applicable for use on metallic surfaces prior to the application of paints utilized as top coats and/or prime coats. All types of paints including solvent or water-borne paints as well as powder coatings exhibit improved properties when applied over metallic surfaces treated with the seal rinse of the present invention.

DISCUSSION OF THE ROLE OF COMPONENTS

The (2-benzothiazolylthio) succinic acid is present in the concentrated formulation within a range of 1–35% by weight. The amount of (2-benzothiazolylthio) succinic acid has a direct effect on the amount of morpholine needed to make the salt of the organic acid. The working solution will be controlled by the appropriate dilution of the seal rinse product for each individual case.

Morpholine is present as an alkalinity source to neutralize the non-passive nature of the organic acid and to prevent flash rusting. Further, the morpholine is present because it forms a film with the organic acid which acts as a sealer on the metal substrate. Unlike the use of (2-benzothiazolylthio) succinic acid in coatings formulations where it is distributed throughout the coating itself, this seal rinse puts the corrosion resistant properties of the morpholine salt directly onto the metal surface in a concentrated manner resulting in increased corrosion protection. Morpholine is a relatively safe amine source which has restrictions only by skin contact (which can be eliminated by proper safety equipment generic to handling industrial chemicals, i.e., rubber gloves). Morpholine is also desirable because its volatility at room temperatures and elevated temperatures leaves only the amine salt on the surface of the metal without any excess alkalinity which can interfere with good adhesion and reduce the corrosion protection.

It will be appreciated that those skilled in the art may depart from the description of the specific examples herein without actually departing from the spirit and scope of the present invention.

What is claimed is:

1. The method of treating metallic surfaces for increasing corrosion protection of painted products which includes the steps of:

(a) exposing the metallic surface to a phosphate treatment;

(b) exposing the metallic surface to a seal rinse composed of the following formulation:

| Ingredient | Percent by Weight |
|---|---|
| morpholine | 0.5–35% |
| (2-benzothiazolylthio) succinic acid | 1–35% |
| water | 30–98.5% |

and wherein the seal rinse is used in a working solution at a range of from 0.1 to 3% by volume at a temperature of up to 140° F. for a period of at least 5 seconds.

* * * * *